US011319858B2

(12) United States Patent
Lee et al.

(10) Patent No.: US 11,319,858 B2
(45) Date of Patent: May 3, 2022

(54) MUFFLER HAVING MOVABLE BAFFLE AND CONTROL METHOD OF THE SAME

(71) Applicants: Hyundai Motor Company, Seoul (KR); Kia Motors Corporation, Seoul (KR)

(72) Inventors: Sang-Ho Lee, Andong-Si (KR); Ju-Hyun Kim, Suwon-si (KR); Il-Won Jung, Gwangju (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 611 days.

(21) Appl. No.: 16/212,335

(22) Filed: Dec. 6, 2018

(65) Prior Publication Data

US 2019/0301340 A1 Oct. 3, 2019

(30) Foreign Application Priority Data

Mar. 30, 2018 (KR) ..... 10-2018-00037430

(51) Int. Cl.
*F01N 13/00* (2010.01)
*F01N 1/16* (2006.01)
*G10K 11/162* (2006.01)

(52) U.S. Cl.
CPC ..... *F01N 13/007* (2013.01); *F01N 1/166* (2013.01); *F01N 1/168* (2013.01); *G10K 11/162* (2013.01); *F01N 2260/20* (2013.01)

(58) Field of Classification Search
CPC ..... F01N 13/007; F01N 1/166; F01N 1/168; F01N 2260/20
See application file for complete search history.

(56) References Cited

U.S. PATENT DOCUMENTS 3,253,676 A * 5/1966 Bottum ..... F01N 1/165 181/241
5,475,189 A * 12/1995 Field ..... F16L 55/0333 181/241

(Continued)

FOREIGN PATENT DOCUMENTS

CN 201865728 U 6/2011
CN 102477883 A 5/2012

(Continued)

OTHER PUBLICATIONS

Office Action of Chinese Patent Office dated Nov. 2, 2021 in Appl'n No. 201811509340.1.

*Primary Examiner* — Jeremy A Luks
(74) *Attorney, Agent, or Firm* — Morgan, Lewis & Bockius LLP

(57) ABSTRACT

A muffler having a movable baffle may include a housing where an input pipe into which exhaust gas is flowed from an engine and an output pipe through which the exhaust gas is expelled to atmosphere are disposed, a baffle which is configured to be slidable along the longitudinal direction of the housing and divides the space of the housing, baffle moving means for moving the baffle to an arbitrary position within a predetermined range along the longitudinal direction of the housing, and a controller which data for determining whether to move the baffle or not is input thereto when the engine is driven, determines whether to move the baffle or not by use of the input data and controls the baffle moving means when the baffle is determined to be moved.

7 Claims, 5 Drawing Sheets

(56) References Cited

U.S. PATENT DOCUMENTS

| | | | | |
|---|---|---|---|---|
| 6,769,511 | B1 * | 8/2004 | Brooks | F01N 1/02 181/212 |
| 6,915,876 | B2 * | 7/2005 | Ciray | F01N 1/16 181/219 |
| 7,117,974 | B2 * | 10/2006 | Moenssen | F02M 35/1216 181/277 |
| 7,337,877 | B2 * | 3/2008 | Goenka | F02M 35/1261 123/184.56 |
| 7,690,478 | B2 * | 4/2010 | Kostun | F02M 35/1255 181/250 |
| 8,931,589 | B2 * | 1/2015 | Bothien | F23M 20/005 181/241 |
| 2004/0118632 | A1 | 6/2004 | Ciray | |
| 2018/0293814 | A1 * | 10/2018 | Gilbert | B60W 40/00 |

FOREIGN PATENT DOCUMENTS

| | | | |
|---|---|---|---|
| EP | 1 445 437 | A1 | 8/2004 |
| KR | 19980050753 | U | 10/1998 |
| KR | 19990039683 | U | 11/1999 |
| KR | 20040037922 | A | 5/2004 |
| KR | 20170131890 | A | 12/2017 |

* cited by examiner

MUFFLER HAVING MOVABLE BAFFLE AND CONTROL METHOD OF THE SAME

CROSS-REFERENCE TO RELATED APPLICATION

The present application claims priority to Korean Patent Application No. 10-2018-0037430 filed on Mar. 30, 2018, the entire contents of which is incorporated herein for all purposes by this reference.

BACKGROUND OF THE DISCLOSURE

Field of the Disclosure

The present invention relates to a muffler having movable baffle and control method of the same able to tune an exhaust sound by moving the baffle inside the muffler.

Description of Related Art

The exhaust gas which is combusted in an engine is expelled to the outside through an exhaust line. At this time, the exhaust gas passes through a muffler to control the exhaust sound.

The exhaust sound is controlled while passes through the muffler. Normally, it is controlled to reduce the exhaust sound, and in some vehicles, it is also controlled to emphasize the exhaust sound.

The muffler is disposed with a baffle fixed inside, so that it is configured to control the exhaust sound of a predetermined band.

On the other hand, some mufflers allow the baffle to move inside the mufflers so that the exhaust sound of different bands may be controlled.

As shown in FIG. 1, a basic structure of muffler is provided with a housing 111, an input pipe 113 through which exhaust gas is flowed into from engine 1, and an output pipe 114 exhausting the exhaust gas to atmosphere. A plurality of baffles 121 are disposed inside the housing 111 to divide the internal space of the housing 111 into a plurality of spaces. The baffle 121 is configured to be slid by use of an electromagnet 123. The electromagnet 123 is disposed at one side of the baffle 121 or the housing 111, and a baffle guide 125 for guiding the sliding movement of the baffle 121 is disposed. When the electromagnet 123 is energized, the baffle 121 slides inside the housing 111 and controls the exhaust sound by varying the size of the space separated from the housing 111 by varying the location of the baffle 121. For example, the exhaust sound is controlled by narrowing or widening the gap between the baffles 121 according to the revolutions per minute (rpm) of the engine 1.

Controlling the distance between the baffles 121 using the electromagnet 123 is simple in principle and easy to control.

However, as the related art, controlling the position of the baffle 121 with electromagnet 123 has a problem that the position of the baffle 121 cannot be controlled as desired. In other words, since the position of the baffle 121 may be controlled only to two positions before and after magnetization of the electromagnet 123 depending on whether the electromagnet 123 is magnetized or not, the location of the baffle 121 could not be precisely controlled with the optimum condition depending on the revolutions per minute of the engine 1.

As a result, ride comfort deteriorates with excessive exhaust sound, and there is a problem that requires separate tuning to control the exhaust sound.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a muffler having a movable baffle and control method of the same configured for maximizing the exhaust sound reduction effect depending on the revolutions per minute of the engine by precisely controlling the desired position of the baffle in the housing within a predetermined range.

A muffler having movable baffle according to an exemplary embodiment of the present invention may include a housing where an input pipe into which exhaust gas is flowed from an engine and an output pipe through which the exhaust gas is expelled to atmosphere are disposed; a baffle which is configured to be slidable along the longitudinal direction of the housing and divides the space of the housing; baffle moving means for moving the baffle to an arbitrary position within a predetermined range along the longitudinal direction of the housing; and a controller which data for determining whether to move the baffle or not is input thereto when the engine is driven, determines whether to move the baffle or not by use of the input data and controls the baffle moving means when the baffle is determined to be moved.

The baffle moving means may include a drive motor disposed at one side of the housing; a ball screw rotated by the drive motor; and a transfer frame which is screwed with one side of the ball screw to be slid by the rotation of the ball screw and the baffle is fixed thereto.

The ball screw may be disposed along the longitudinal direction of the housing; and a transfer guide disposed at a predetermined angle interval along the circumference of the housing to guide the sliding movement of the transfer frame may be further included.

The transfer guide may be disposed in plural at a predetermined interval along the circumference of the housing.

The transfer frame may be provided with at least one or more arm to extend in the radial direction of the transfer frame; and the arm may be engaged with the ball screw or connected to the transfer guide so that the transfer guide penetrates the arm.

An engage block engaged with the ball screw may be formed at an end portion of the arm.

A guide block through which the transfer guide penetrates may be formed at the end portion of the arm.

The controller may be configured to determine a target position of the baffle when data including revolutions per minute (rpm) of the engine, a temperature of the exhaust gas, a flow rate of the exhaust gas, a current position of the baffle, and a boost pressure are input and compares the target position with a current position of the baffle; and operate the baffle moving means when the current position of the baffle is different from the target position to move the baffle to target position.

A control method of a muffler having a movable baffle according to an exemplary embodiment of the present invention, including a housing where an input pipe into which exhaust gas is flowed from an engine and an output pipe through which the exhaust gas is expelled to atmosphere are disposed, a baffle which is configured to be slidable along the longitudinal direction of the housing and divides the space of the housing, baffle moving means for moving the baffle to an arbitrary position within a predetermined range along the longitudinal direction of the housing, and a controller which data for determining whether to move the baffle or not is input thereto when the engine is driven, determines whether to move the baffle or not by use of the input data and controls the baffle moving means when the baffle is determined to be moved may include receiving data necessary for determining whether to move the baffle or not when engine is started; comparing, by the controller, the current position of the baffle with the target position of the baffle determined by the input data to determine whether to move the baffle or not; and operating the baffle moving means so that the baffle can move to the target position.

The input data may include revolution per minute (rpm) of the engine, a temperature of the exhaust gas, a flow rate of the exhaust gas, a current position of the baffle, and a boost pressure in the receiving data.

The target position of the baffle may be determined by a reinforcement learning algorithm in the comparing.

The reinforcement learning algorithm may set the position of a partition wall by the revolutions per minute of the engine in which the exhaust sound is minimum and set the movement amount of the baffle high to the direction in which the exhaust sound is minimum.

Determining whether the engine is turned off or not may be further included after operating the baffle moving means so that the baffle can move to the target position, and returning to the receiving data when it is determined that the engine is driving in the determining whether the engine is turned off or not.

According to the muffler having the movable baffle and the control method of the same of the present invention having the above configuration, it is possible to precisely control the position of the baffle in the housing to a desired position within a predetermined range, so that the baffle may be moved to the optimum position depending on an engine RPM.

It is varied the frequency range of the exhaust sound which may be controlled by the muffler as the baffle moves, the noise reduction effect may be maximized depending on the revolutions per minute of the engine.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
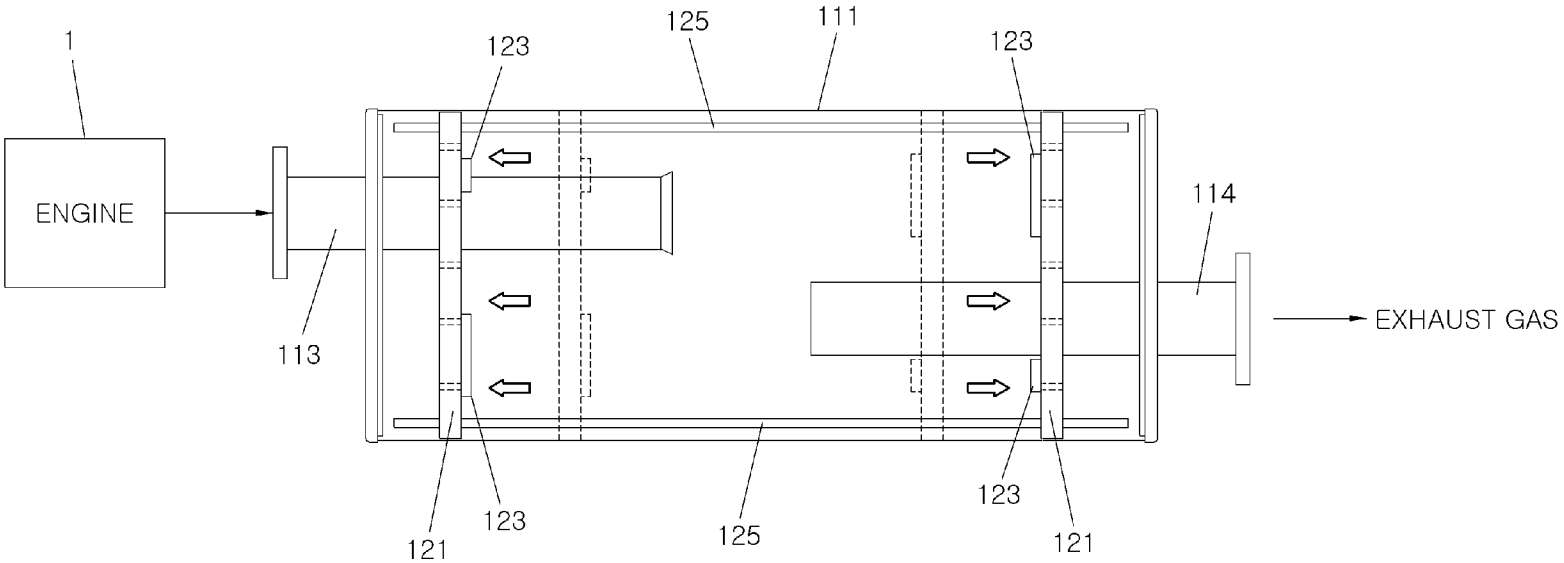
FIG. 1 is a cross-sectional view showing the muffler in which the baffle moves according to the related art.
Figure 2:
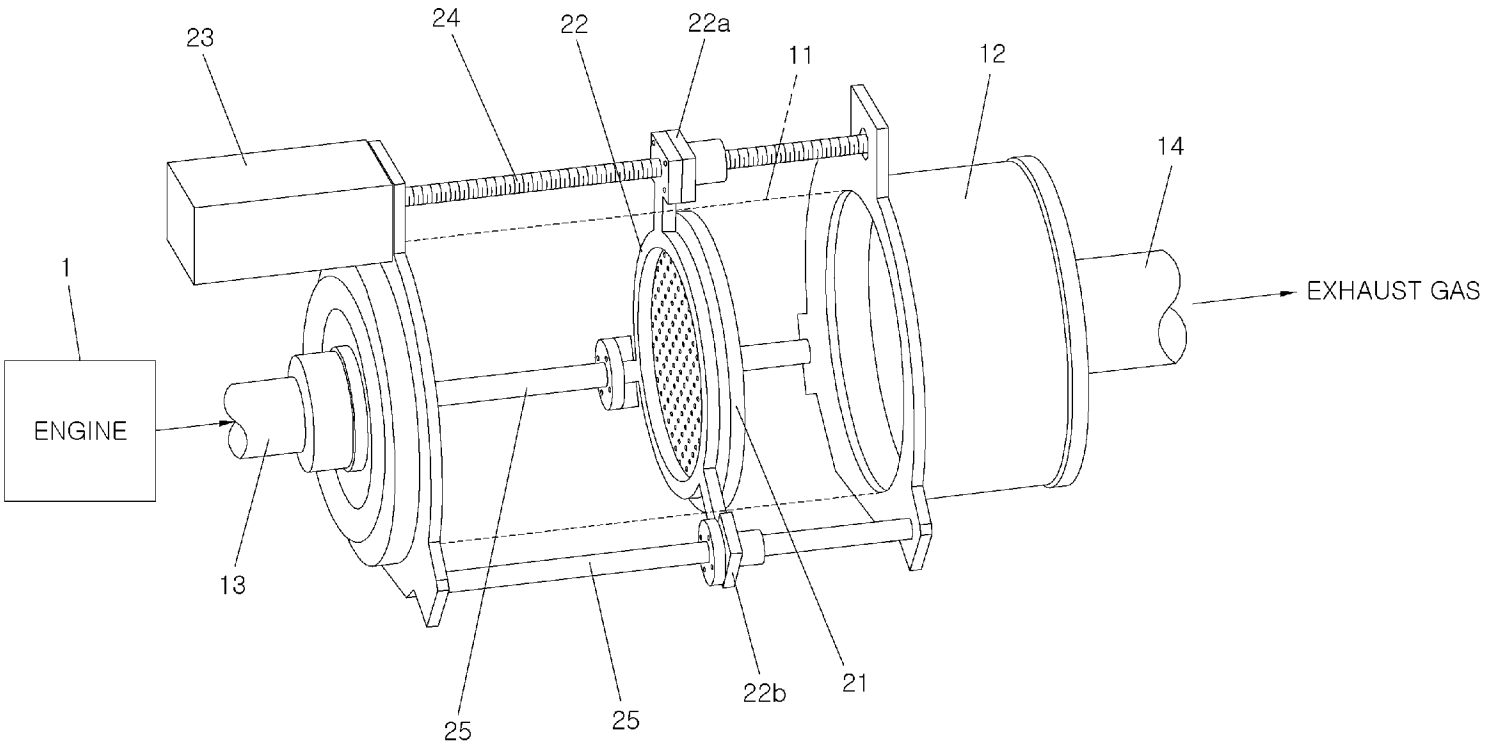
FIG. 2 is a cut-away perspective view of a muffler having a movable baffle according to an exemplary embodiment of the present invention.
Figure 3:
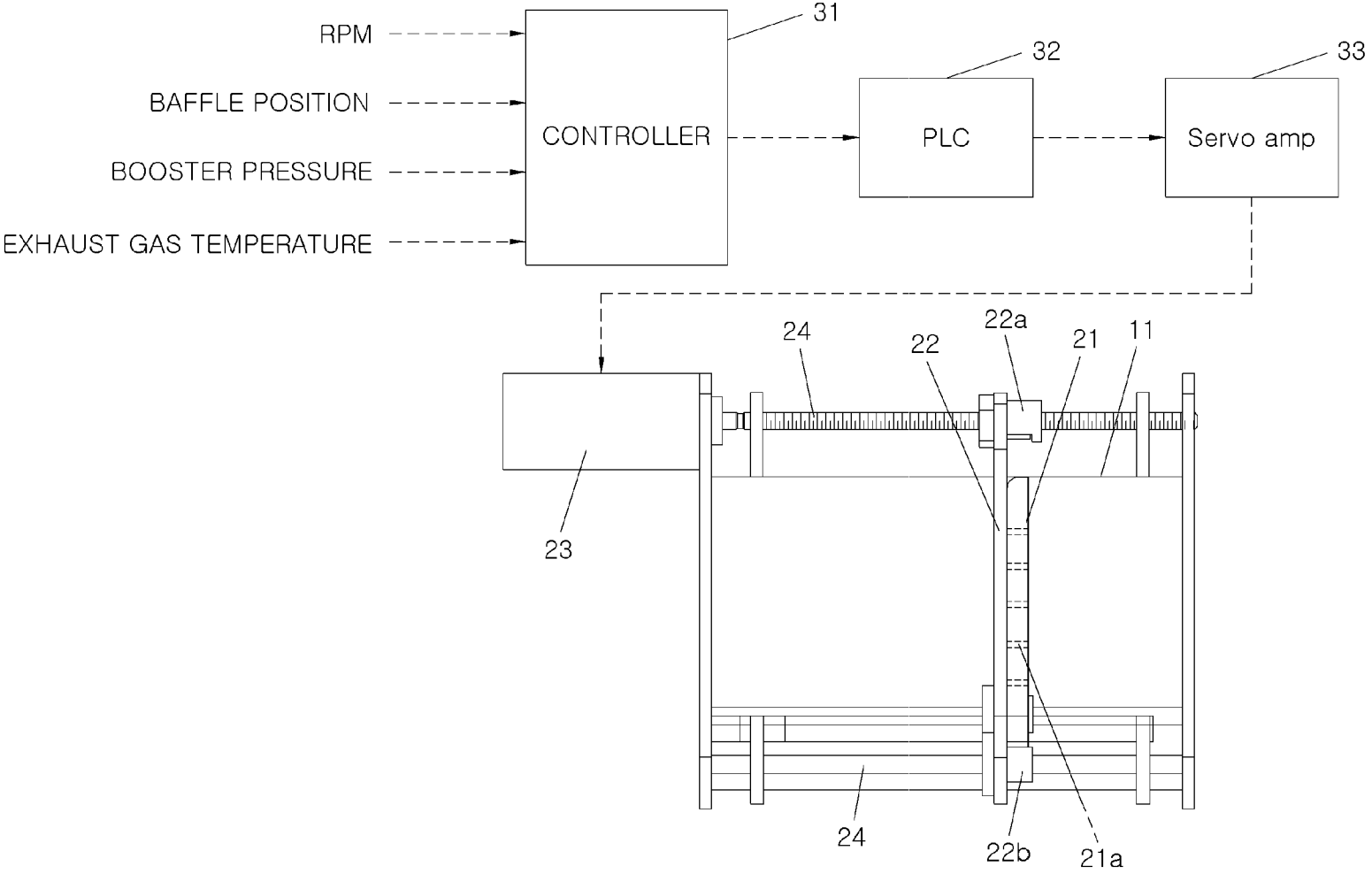
FIG. 3 is a block diagram showing the muffler having the movable baffle according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, a muffler having a movable baffle and control method of the same according to an exemplary embodiment of the present invention will be described in detail with reference to the accompanying drawings.

A muffler having a movable baffle according to an exemplary embodiment of the present invention may include, a housing 11 where an input pipe 13 into which exhaust gas is flowed from an engine 1 and an output pipe through which the exhaust gas is expelled to atmosphere are disposed, a baffle 21 which is configured to be slidable along the longitudinal direction of the housing 11 and divides the space of the housing 11, baffle moving means for moving the baffle 21 to an arbitrary position within a predetermined range along the longitudinal direction of the housing 11, and a controller 31 which data for determining whether to move the baffle 21 or not is input thereto when the engine is driven, determines whether to move the baffle 21 or not by use of the input data and controls the baffle moving means when the baffle is determined to be moved 21.

A space in which exhaust gas expelled from the engine 1 can flow may be formed in the housing 11.

The housing 11 may be formed of a cylindrical shape, and the exhaust gas passes in the longitudinal direction of the housing 11 to reduce an exhaust sound.

The housing 11 may be formed to have a predetermined length, and the input pipe 13 into which the exhaust gas expelled from the engine 1 flows and the output pipe 14 through which the exhaust gas is exhausted from the housing 11 to atmosphere, may be disposed in the housing 11.

A connecting portion 12 may be connected to one side of housing 11. The connecting portion 12 may be formed of a cylindrical shape between the housing 11 and the output pipe 14.

The baffle 21 may be formed to divide the internal space of the housing 11 inside the housing 11.

The baffle 21 may be formed with a penetration hole 21*a* through which the exhaust gas passes. In the state that the baffle 21 basically divides the internal space of the housing 11, the exhaust gas flows through the penetration hole 21*a* to reduce the exhaust sound.

At the instant time, the baffle 21 moves along the longitudinal direction of the housing 11 inside the housing 11 to vary the size of the space divided by the baffle 21 so that the frequency range of the exhaust sound able to be reduced in the muffler may be changed.

The baffle moving means moves the baffle 21 to the longitudinal direction of the housing 11 by the control signal of the controller 31.

As an example of the baffle moving means, a ball screw 24 for converting the rotational motion into a linear motion may be included. That is, the baffle moving means includes a drive motor 23 driven by a signal of the controller 31, a ball screw 24 rotated by the drive motor 23, and a transfer frame 22 into which one side of the ball screw 24 is screwed to move along the longitudinal direction of the housing 11 when the ball screw 24 rotates and in which the baffle 21 is disposed.

The drive motor 23 rotates to generate driving torque when a control signal is input from controller 31. The drive motor 23 may be disposed at one side of the housing 11. The drive motor 23 is preferably provided as a servo motor which is feedback controlled so that the target value and the control value become equal. The drive motor 23 generates the driving torque required to move the baffle 21 in the forward/reverse direction depending on the control signal.

The ball screw 24 may be connected to the rotation shaft of the drive motor 23 to be rotated. The ball screw 24 may be disposed in the longitudinal direction of the housing 11. The ball screw 24 is for converting the rotational motion into a linear motion, and the position of the baffle 21 may be moved to an arbitrary position according to the amount of rotation. It is not possible to control precise position because electromagnet is used to change the position of baffle in related art. However, by applying ball screw 24, it is possible to move the baffle 21 to any position in the section where the ball screw 24 is disposed.

The transfer frame 22 is transferred to the longitudinal direction of the housing 11 when the ball screw 24 is rotated. The transfer frame 22 may be formed in an annular shape, and the circumference of the transfer frame 22 may be fixed to a baffle 21 dividing the internal space of the housing 11.

The circumference of the transfer frame 22 may include an arm formed to extend in the radial direction of the transfer frame 22 and an engage block 22*a* engaging the ball screw 24 may be formed at the end portion of the arm.

The drive motor 23 and the ball screw 24 may be provided in plural along the circumference of the housing 11 and to this, the engage block 22*a* may be formed in the transfer frame 22, but the drive motor 23 and the ball screw 24 may be disposed by one at the circumference of the housing 11 and a transfer guide 25 may be disposed at an interval from the ball screw 24 so that the transfer guide 25 guides movement of the transfer frame 22.

At least one or more transfer guide 25 may be disposed at an interval from the ball screw 24 along the circumference of the housing 11.

A guide block 22*b* through which the transfer guide 25 passes may be formed at the end portion of the arm formed in the circumference of the transfer frame 22.

The transfer frame 22 may be formed with the arm at an interval along the circumference direction and the engage block 22*a* or the guide block 22*b* may be formed at the end portion of the arm so that the transfer frame 22 can stably move along the longitudinal direction of the housing 11.

The controller 31 receives data from various sensors disposed on the vehicle, sets the location of the baffle 21 by the input data, and operates the baffle moving means to move the baffle 21 to a predetermined position. For example, the data input to the controller 31 may be revolutions per minute (rpm) of the engine 1, a temperature of the exhaust gas, the current position of the baffle 21, a boost pressure, and the like.

In the controller 31, the algorithm for determining the baffle 21 is stored. The position of the baffle 21 is determined using the input data, and the baffle 21 is controlled to move to the determined position.

The control signal of the controller 31 may be input directly to the drive motor 23, but is preferably transmitted through a PLC (Programmable Logic Controller) 32 and a servo amplifier (Servo Amp) 33. That is, in the PLC 32, the control signal of the controller 31 is compiled and built and then transmitted to the servo amplifier 33, and the servo amplifier 33 actually outputs a signal for controlling the drive motor 23.

Hereinafter, the control method of the muffler having the movable the baffle according to an exemplary embodiment of the present invention will be described in detail with reference to the attached drawing.

Figure 5:
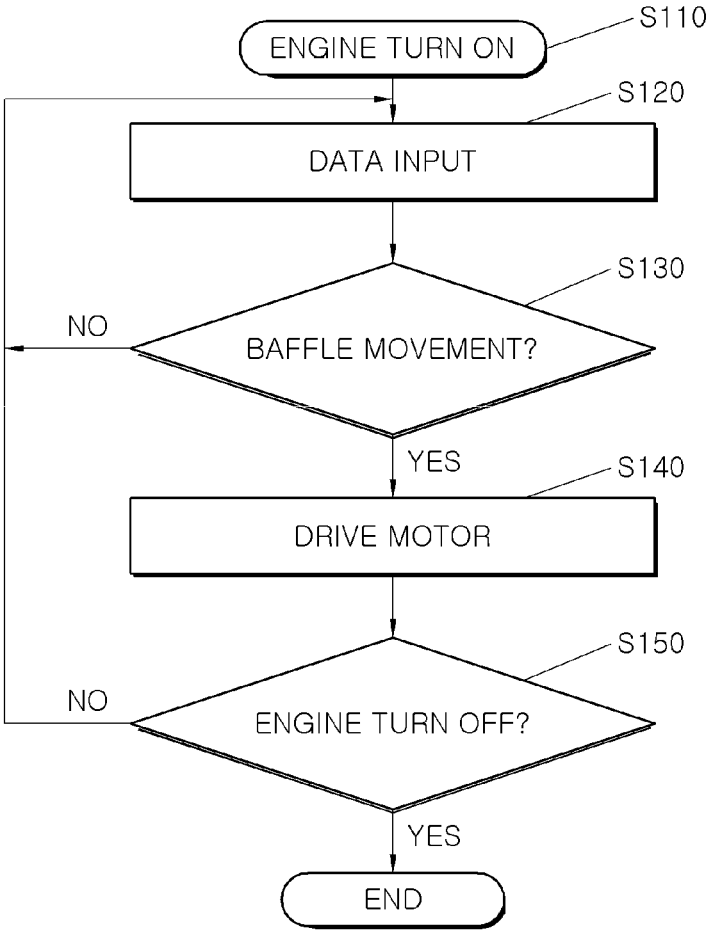
FIG. 5 is a flow chart showing the control method of the muffler having the movable baffle according to an exemplary embodiment of the present invention.

FIG. 5 shows the control method of the muffler having the movable baffle according to an exemplary embodiment of the present invention.

The control method of the muffler having the movable baffle according to an exemplary embodiment of the present invention may include a data input step S120 for receiving data necessary for determining whether to move the baffle 21 or not when engine 1 is started, a baffle position comparison step S130 for comparing, by the controller 31, the current position of the baffle 21 with the target position of the baffle 21 determined by the input data to determine whether to move the baffle 21 or not, and a baffle moving step S140 for operating the baffle moving means so that the baffle 21 can move to the target position.

In the data input step S120, when the engine 1 is started at S110, data depending on the operation of the engine 1 is input to the controller 31. In the data input step S120, the input data to the controller 31 are the revolution per minute (rpm) of the engine 1, the temperature of the exhaust gas, the flow rate of the exhaust gas, the current position of the baffle 21, and the boost pressure, and the like.

In the baffle position comparison step S130, the controller 31 compares the current position of the baffle 21 with the target position of the baffle 21 determined by the input data. The controller 31 determines whether to move the baffle 21 or not by comparing the current position of the baffle 21 with the determined target position of the baffle 21. In the controller 31, the position of the baffle 21 depending on the input data such as the revolutions per minute (rpm) of the engine 1, the exhaust gas temperature, the exhaust gas flow rate, the current position of the baffle 21, and the boost pressure, and the like, is stored in advance. That is, after the total noise depending on the revolutions per minute (rpm) of the engine 1, the exhaust gas temperature, the exhaust gas flow rate, the current position of the baffle 21, and the boost pressure are measured, the target position of the baffle 21 configured for optimizing these is mapped to the controller 31. Accordingly, the controller 31 compares the current position of the baffle 21 with the target position of the baffle 21 in the baffle position comparison step S130 to determine whether the movement of the baffle 21 or not.

On the other hand, to determine the target position of the baffle 21 in the baffle position comparison step S130, the target position of the baffle 21 may be determined by a reinforcement learning algorithm. That is, in the reinforcement learning algorithm of the controller 31 is stored to set the position of the baffle 21 by the engine RPM in which the exhaust sound is minimum, and set the compensation value (movement amount of the baffle) high to the direction in which the exhaust sound is minimum. The reinforcement learning algorithm stored in the controller 31 is not permanently applied to the values stored in advance in the controller 31, but learns to reflect it to the controller 31 again when the noise of the vehicle is directly detected or indirectly determined.

In the baffle moving step S140, the controller 31 drives the drive motor 23 to move the baffle 21 to the target position. When the drive motor 23 is driven, the ball screw 24 rotates so that the baffle 21 can move to the target position inside the housing 11. The moving direction of the baffle 21 may be changed depending on the rotating direction of the drive motor 23 and the moving distance of the baffle 21 may be increased in proportion to the operating time of the drive motor 23.

An engine off determination step S150 determines whether the engine 1 is turned off, and if the engine 1 is not turned off, it is returned to the data input step S120. When it is determined that the engine 1 is not turned off in the engine off determination step S150, that is, when it is determined that the engine 1 is running, it is returned to the data input step S120 to repeatedly perform the data input step S120 to the baffle moving step S140.

Figure 4:
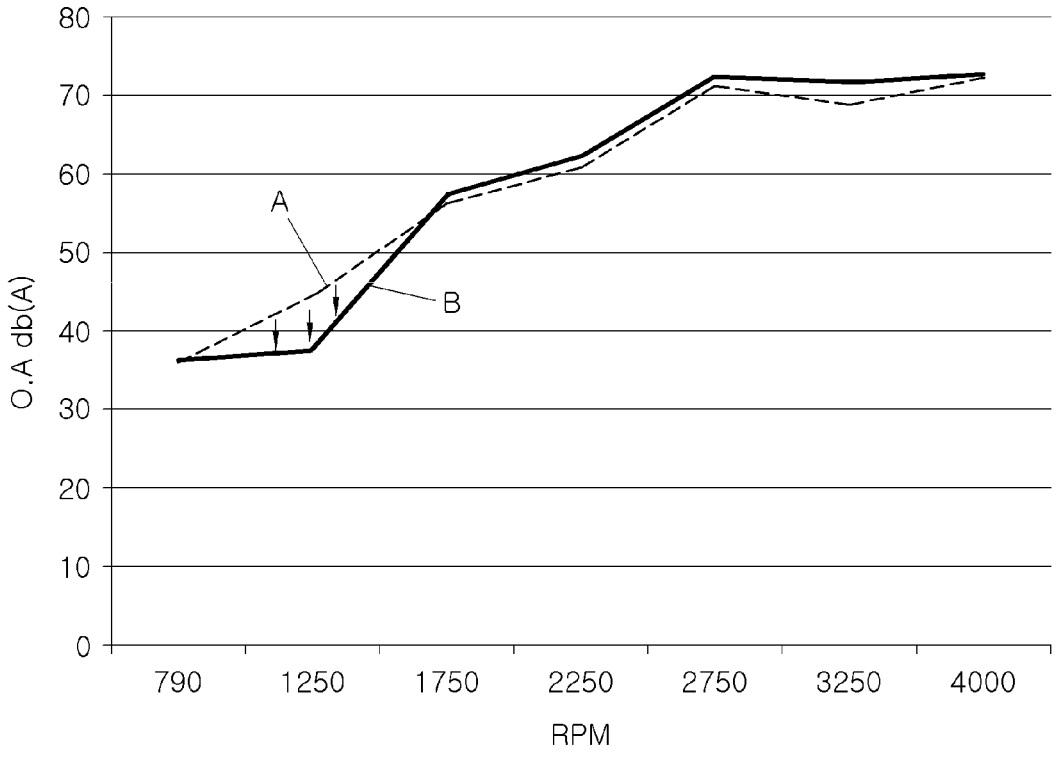
FIG. 4 shows an effect by the muffler having the movable baffle and control method of the same according to an exemplary embodiment of the present invention.

In accordance with the muffler having the movable baffle and control method of the same according to an exemplary embodiment of the present invention, as shown in FIG. 4, it is possible to obtain an effect that overall noise (O.A) may be reduced. As shown in FIG. 4, it is possible to obtain the reduced noise (B) by varying the position of the baffle 21 depending on the driving state of the vehicle, in contrast to the noise (A) occurring in the muffler with fixed baffle.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A muffler apparatus having a movable baffle, the muffler apparatus comprising:

a housing including an input pipe into which exhaust gas is flowed from an engine and an output pipe through which the exhaust gas is expelled to atmosphere;

a baffle slidable along a longitudinal direction of the housing and dividing an inner space of the housing;

a baffle moving device coupled to the movable baffle and configured for selectively moving the movable baffle to a position within a predetermined range along the longitudinal direction of the housing; and a controller to which data for determining when the movable baffle is moved is input when the engine is driven, wherein the controller is configured to determine when the movable baffle is moved by use of the input data and configured to control the baffle moving device when the movable baffle is determined to be moved, and wherein the baffle moving device includes:

a drive actuator mounted at a side of the housing and connected to the controller;

a ball screw coupled to the drive actuator and rotated by the drive actuator; and a transfer frame which is screwed with a side of the ball screw, wherein the movable baffle is fixed to the transfer frame and configured to be slid by a rotation of the ball screw.

2. The muffler apparatus having the movable baffle of claim 1, wherein the ball screw is mounted along the longitudinal direction of the housing; and wherein a transfer guide mounted at a predetermined angle interval along a circumference of the housing to guide a sliding movement of the transfer frame is mounted to the transfer frame.

3. The muffler apparatus having the movable baffle of claim 2, wherein the transfer guide is mounted in plural at a predetermined interval along the circumference of the housing.

4. The muffler apparatus having the movable baffle of claim 3, wherein the transfer frame is provided with at least an arm to extend in a radial direction of the transfer frame; and wherein the at least an arm is engaged with the ball screw or connected to the transfer guide so that the transfer guide penetrates the at least an arm.

5. The muffler apparatus having the movable baffle of claim 4, wherein an engage block engaged with the ball screw is formed at an end portion of the at least an arm.

6. The muffler apparatus having the movable baffle of claim 4, wherein a guide block through which the transfer guide penetrates is formed at an end portion of the at least an arm.

7. The muffler apparatus having the movable baffle of claim 1, wherein the controller is configured to:

determine a target position of the movable baffle when the data including revolutions per minute (rpm) of the engine, a temperature of the exhaust gas, a flow rate of the exhaust gas, a current position of the movable baffle, and a boost pressure are input to the controller and compare the target position with the current position of the movable baffle; and operate the baffle moving device when the current position of the movable baffle is different from the target position to move the movable baffle to the target position.

* * * * *